US005636880A

United States Patent [19]

Miller et al.

[11] Patent Number: 5,636,880

[45] Date of Patent: Jun. 10, 1997

[54] ELECTRONIC LOCK

[75] Inventors: Edward J. Miller, Falls Church; John G. Thacker, Charlottesville, both of Va.

[73] Assignee: Milocon Corporation, Falls Church, Va.

[21] Appl. No.: 541,059

[22] Filed: Oct. 11, 1995

[51] Int. Cl.[6] ..... E05C 1/06

[52] U.S. Cl. ..... 292/144; 292/140; 292/92; 70/129

[58] Field of Search ..... 292/144, 138, 292/57, 58, 201, 92, 140; 70/129

[56] References Cited

U.S. PATENT DOCUMENTS

| | | | |
|---|---|---|---|
| 2,989,859 | 6/1961 | Leads . | |
| 3,011,817 | 12/1961 | Leads . | |
| 3,073,143 | 1/1963 | Leads . | |
| 3,157,042 | 11/1964 | Wolz . | |
| 3,234,766 | 2/1966 | O'Brien . | |
| 3,479,851 | 11/1969 | Davidson et al. . | |
| 3,521,921 | 7/1970 | Miyazaki . | |
| 3,576,119 | 4/1971 | Harris . | |
| 3,695,068 | 10/1972 | Eads et al. . | |
| 3,792,888 | 2/1974 | Kambic . | |
| 3,869,159 | 3/1975 | Eads . | |
| 3,893,723 | 7/1975 | Boule . | |
| 3,894,417 | 7/1975 | Taniyama . | |
| 3,899,906 | 8/1975 | Bradstock . | |
| 3,901,542 | 8/1975 | Salzmann et al. . | |
| 4,021,065 | 5/1977 | Geringer | 292/144 |
| 4,073,518 | 2/1978 | Goodwin . | |
| 4,099,752 | 7/1978 | Geringer | 292/144 |
| 4,218,903 | 8/1980 | Eads . | |
| 4,509,347 | 4/1985 | Young . | |
| 4,579,376 | 4/1986 | Charlton . | |
| 4,593,543 | 6/1986 | Stefanek . | |
| 4,633,688 | 1/1987 | Beudat et al. . | |
| 4,637,237 | 1/1987 | Witkoski et al. . | |
| 4,640,108 | 2/1987 | Young | 70/129 |
| 4,643,005 | 2/1987 | Logas . | |
| 4,656,850 | 4/1987 | Tabata . | |
| 4,677,834 | 7/1987 | Hicks . | |
| 4,691,542 | 9/1987 | Young | 70/129 |
| 4,730,471 | 3/1988 | Seckinger et al. . | |
| 4,761,976 | 8/1988 | Kleinhany . | |
| 4,799,719 | 1/1989 | Wood . | |
| 4,833,465 | 5/1989 | Abend et al. . | |
| 4,902,053 | 2/1990 | Hakkarainen et al. | 292/144 |
| 4,907,429 | 3/1990 | Davis et al. . | |
| 4,913,475 | 4/1990 | Bushnell et al. | 292/144 |
| 5,083,448 | 1/1992 | Karkkainen et al. . | |
| 5,100,184 | 3/1992 | Schmitt | 292/144 |
| 5,199,288 | 4/1993 | Merilainen et al. . | |
| 5,377,513 | 1/1995 | Miyamoto et al. . | |
| 5,421,178 | 6/1995 | Hamel et al. . | |

*Primary Examiner*—Steven N. Meyers
*Assistant Examiner*—Donald J. Lecher
*Attorney, Agent, or Firm*—Lowe, Price, LeBlanc & Becker

[57] ABSTRACT

An electronic lock mechanism includes a solenoid driven actuator and a cam actuator ring. The cam ring interfaces with both the latch of a door lock and the door lock key cylinder. With this interfacing, the door latch can be independently operated by one of the key cylinder, the cam actuator ring or a door lock push bar or paddle. With this independent operation, the ability to open a door can be maintained during power or lock mechanism failures for purpose of egress from the area secured by the door lock.

14 Claims, 2 Drawing Sheets

ELECTRONIC LOCK

FIELD OF THE INVENTION

The present invention is directed to an electronic lock and, in particular, to an electronic lock especially adapted for narrow stile lock mechanisms.

BACKGROUND ART

In the prior art, various types of electronic door locks have been proposed. One type involves an electronic strike which is mounted in the frame of a door. In this type of lock, the strike is operated electronically to catch or release the door latch of the door for locking or unlocking purposes.

U.S. Pat. No. 5,100,184 to Schmitt discloses another type of lock or deadlatch assembly. This deadlatch assembly is designed to allow 2-way traffic, i.e. free entrance and exit at some times and exit-only traffic at other times. These deadlatch assemblies are typically used with narrow type or narrow stile door applications such as aluminum doors. This deadlatch assembly includes a solenoid actuator for moving a deadlatch cam to an unblocking position when an auxiliary bolt is retracted and the door closed. A ramp in the door strike plate and a beveled latch bolt facilitate opening of the door without the need for an electric strike.

Exemplary of a narrow stile door lock mechanism is U.S. Pat. No. 3,011,817 to Eads. These types of door locks are manufactured by Adams Rite Manufacturing Company. Other patents related to these types of door locks include U.S. Pat. Nos. 2,666,321, 2,989,859, 3,073,143, 3,175,376, 3,695,.068, 3,869,159, 3,899,906, 4,218,903, 4,637,237, 4,643,005, 4,848,118 and 5,100,184. These patents are herein incorporated by reference in their entirety for the teachings related to deadlatch assemblies and/or narrow stile door locks.

One of the disadvantages of electronic door strikes is the inability to always permit egress from an area when a power outage or lock malfunction occurs. That is, if an electronic strike is in a position where the door is locked and a power failure occurs, persons within the locked facility cannot escape. This inability to escape represents an extremely hazardous or dangerous situation in the case of a fire, toxic chemical leak or the like. Another problem relates to new codes being enacted wherein persons in the facility must always be able to escape therefrom. Electronic strikes may not be able to meet such codes for the reason described above.

The deadlatch assembly described in U.S. Pat. No. 5,100,184 to Schmitt is disadvantageous in that modifications to an off the shelf deadlatch assembly must be made before the lock can be functional.

In response to the deficiencies above, a need has developed to provide an improved electronic lock which interfaces with existing narrow stile door locks and also allows for free egress from a facility in the case of a power outage, lock malfunction or the like.

Responsive to this need, the present invention provides an electronic lock which interfaces with a conventional narrow stile door lock and which allows electronic control of the door lock while permitting egress from a locked facility if need be.

SUMMARY OF THE INVENTION

Accordingly, it is a first object of the present invention to provide an improved electronic lock.

Another object of the present invention is to provide an electronic lock particularly adaptable for new or existing locks.

A still further object of the present invention is to provide an electronic lock which still permits door operation and egress from a given site in the event of a power failure or an electronic lock component failure.

Other objects and advantages of the present invention will become apparent as a description thereof proceeds.

In satisfaction of the foregoing objects and advantages, the present invention comprises an electronic lock which is particularly suitable for narrow stile door locks.

The electronic lock of the invention comprises an electrically actuated drive such as a solenoid, a cam ring sized to surround a key cylinder of a narrow stile door lock, the cam ring having at least one protrusion thereon which is sized to engage a portion of the latch assembly of the narrow stile door lock. Also provided is a coupling or driver assembly which is configured to convert longitudinal movement of the electrically actuated driver to a rotational movement of the cam ring, the cam ring rotation causing the protrusion thereon to engage a portion of the latch assembly to retract the door latch and permit door opening.

More preferably, the electrically actuated driver is a pin solenoid and the coupling or driver assembly includes a slide actuator plate which moves upwardly and downwardly responsive to the solenoid movement. When using a slide actuator plate, the cam ring includes a second protrusion which engages an opening in the slide actuator plate. Longitudinally movement of the slide actuator plate can then rotate the cam ring for door latch retraction.

The inventive electronic lock is preferably combined with a motion translation mechanism which interfaces with the door latch to prevent exit from a area secured by the narrow stile door lock.

BRIEF DESCRIPTION OF THE DRAWINGS

Reference is now made to the drawings of the invention wherein.

DESCRIPTION OF THE PREFERRED EMBODIMENTS

Figure 1:
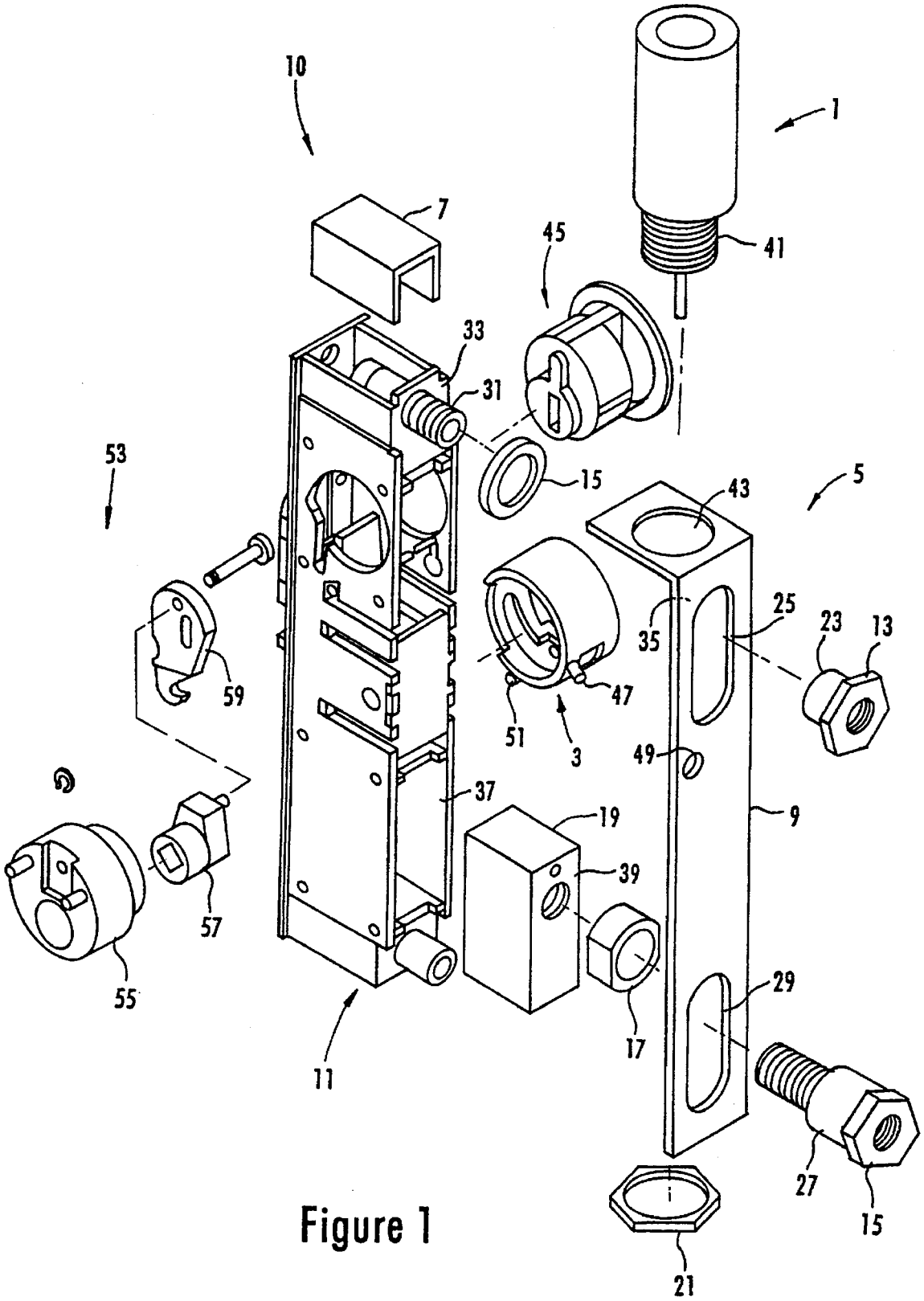
FIG. 1 is an exploded perspective view of the inventive combination lock in combination with a narrow stile door lock.

With reference to FIG. 1, the present invention is generally designated by the reference numeral 10 and is seen to include a pin solenoid 1, a cam ring 3 and a coupling or driver assembly 5.

The driver assembly 5 transmits longitudinal motion of the pin solenoid 1 to the ring cam 3 for lock operation as described below. The driver assembly 5 includes a pin block 7, a slide actuator plate 9, and hardware necessary to adapt the driver assembly 5 to the narrow stile lock 11. This hardware includes an upper shouldered slide nut 13 and washer 15, a lower shouldered slide nut 15, spacer washer 17 and filler block 19. Finally, a solenoid retaining nut 21 is provided which is designed to secure the pin solenoid 1 to the slide actuator plate 9.

It should be understood that the inventive electronic lock is adaptable for any narrow stile door lock or deadlatch assembly. The particular narrow stile lock 11 depicted in FIG. 1 is merely exemplary.

The actuator slide plate 9 interfaces with the lock 11 in the following manner. First, the upper nut 13 includes a shoulder 23 which is sized to slide within the slot 25 in the slot actuator plate 19. Likewise, the nut 15 has a shoulder 27 which is sized to slide within the slot 29 in the slide actuator plate 9. The nut 13 is threadably attached to the threaded protrusion 31 of the lock 11 with the spacer washer 15 positioned between the face 33 on the lock 11 and the inside face 35 of the slide actuator plate 9.

Similarly, the filler block 19 is inserted in the opening 37 of the lock 11 with the spacer washer 17 disposed between the face 39 of the filler block 19 and the inside face 35 of the slide actuator plate 9. The nut 15 is threadably attached to the block 19. The filler block 19 can be secured mechanically or press fit into the opening 37.

The pin block 7 is secured to the lock 11 in any conventional fashion, including a press fit, mechanical fasteners or the like. The pin solenoid 1 is secured to the slide actuator plate 9 by insertion of the pin solenoid portion 1 through the slide actuator plate opening 43. The solenoid retaining nut 21 threadably attaches to the portion 41 so that the pin solenoid is fixedly attached thereto.

The slide actuator plate 9 of the driving assembly 5 is designed to move up and down with motion of the pin solenoid 1. The hardware described above assures that the slide actuator plate 9 maintains its position when driven by the pin solenoid.

The cam ring 3 is sized with an interior diameter to surround and rotate about the key cylinder 5 of the lock 11. The cam ring has two protrusions, a first protrusion 47 designed to engage the opening 49 in the slide actuator plate 9. The second protrusion 51 of the cam ring 3 interfaces with the latch of the lock 11 as will be described in more detail below.

Also shown in FIG. 1 is a motion translation mechanism 53 similar to that disclosed in U.S. Pat. No. 3,869,159 to Eads. As explained in this patent, the motion translation mechanism converts the push or pull force exerted by an operator on a door latch into a rotary motion to open the door. As part of this conventional mechanism, disclosed for illustrative purposes is a spindle disc 55, a driver piece 57 and a release cam 59. As described in the aforementioned Eads patent, a push/pull motion on a door latch is translated into a rotary motion such that the release cam 59 retracts an extended latch of the lock 11 to permit door opening. It should be noted that the release cam 59 could be reversed if a latch rotation opposite that shown in FIG. 1 would be desired.

Figure 2:
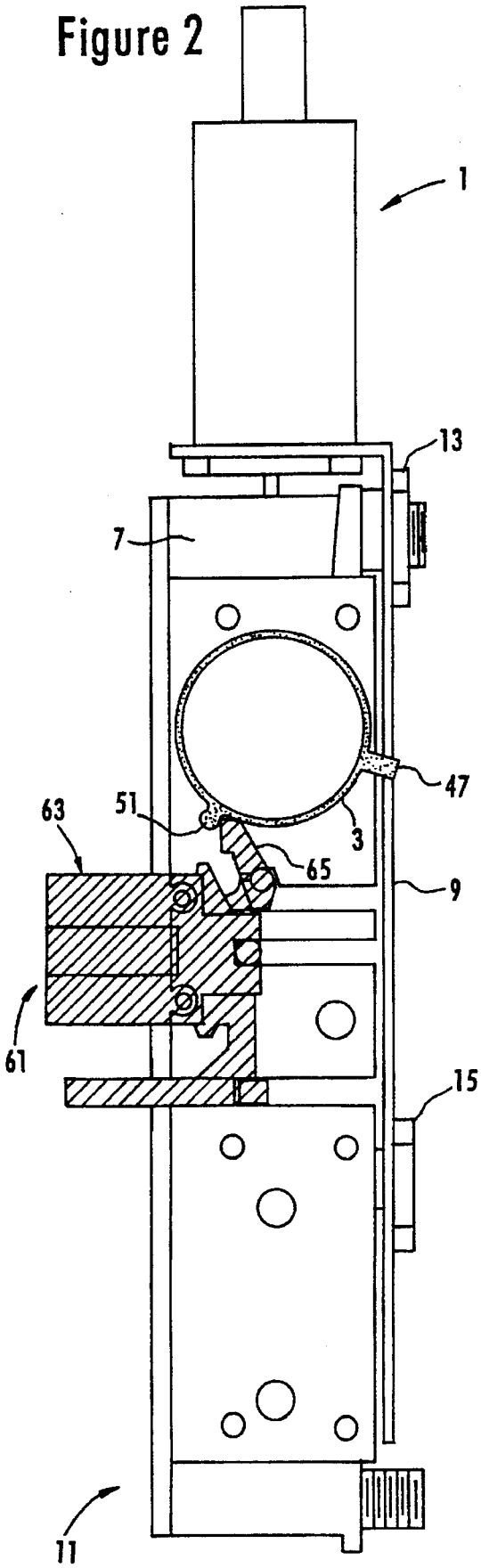
FIGS. 2 and 3 are schematic representations of the inventive door lock showing its motion.
Figure 3:
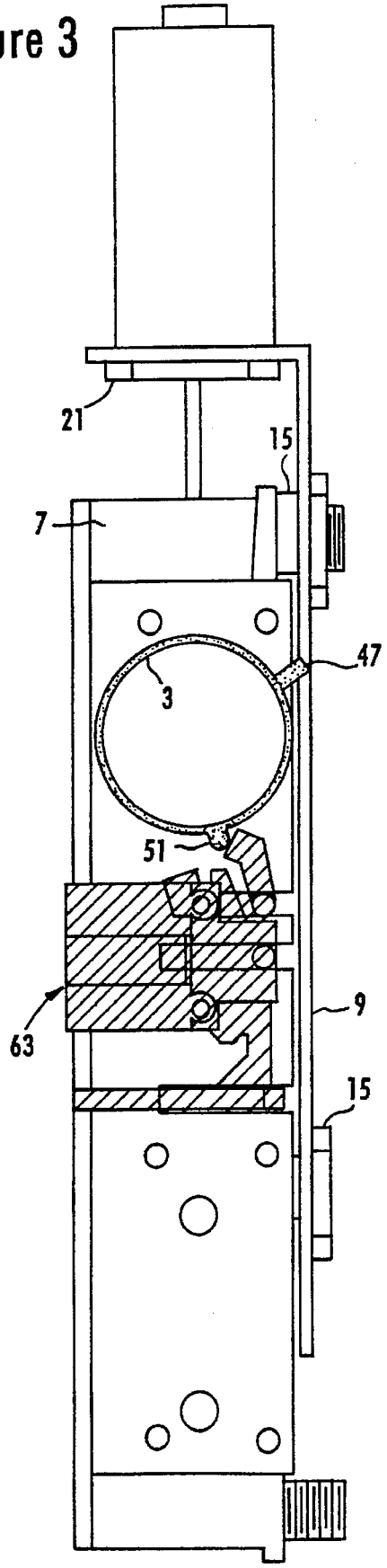

Referring now to FIGS. 2 and 3, operation of the inventive lock mechanism will now be described. In FIG. 2, the latch assembly 61 of tile lock 11 is schematically depicted. The latch assembly 61 includes a latch 63 and latch finger 65. It should be understood that the latch 61 is conventional in its design and a further description of its components is not deemed necessary for understanding of the invention. Typical of this type of latch is the one disclosed in U.S. Pat. No. 5,100,184.

FIG. 2 shows the latch 61 in the extended position and the solenoid pin in the deengergized state. In this configuration, the shouldered nuts 13 and 15 are positioned in the upper portions of the slots 25 and 29, respectively. The protrusion 51 rests against the latch finger 65.

Referring now to FIG. 3, once the solenoid pin is energized, its upward motion moves the slide actuator plate 9 upwardly. Upward movement of the slide actuator plate 9 causes the protrusion 47 to also travel upwardly. This upward movement of the protrusion 47 causes the cam ring 3 to rotate counterclockwise as viewed in FIG. 3. Counterclockwise rotation of the cam ring 3 forces the protrusion 51 against the latch finger 65 such that the latch 63 is fully retracted. Thus, the lock door is now in the unlocked condition for entry or exit purposes.

Deenergizing the pin solenoid 1 reverses movement of the slide actuator plate 9 so that the cam ring rotates clockwise. With deenergization of the pin solenoid 1, the latch 63 could then extend outwardly as shown in FIG. 2 by its known spring bias (not shown).

During the solenoid operation, the solenoid block 7 acts as a restraint against the pin of the solenoid so that its energization results in upward movement of the slide actuator plate 9.

The energization of the pin solenoid can be achieved using any known means and/or systems. For example, a card access control system could be coupled with the pin solenoid such that the use of a properly coded card would result in solenoid energization and lock latch retraction. Alternatively, a button or key switch could also be used wherein switch operation would energize the pin solenoid. Further, the solenoid energization may be performed at a remote location or adjacent the door depending on the particular need of the system utilizing the electronic lock.

Use of the inventive cam ring 3 allows any narrow stile door lock to be retrofitted with the inventive electronic lock. By merely disassembling the known lock and installing the cam ring around the lock key cylinder, a narrow stile door lock is now retrofitted for electronic operation which still allows door lock operation either by the key cylinder or the motion translation mechanism.

The drive assembly 5 depicted in FIG. 1 is only a preferred embodiment of the invention. That is, any assembly which would convert the longitudinal movement of the pin solenoid 1 to a rotational movement of the cam ring 3 so as to retract the latch 63 can be utilized with the present invention. For example, a different type of narrow stile lock may be required which would necessitate mounting the slide actuator plate 9 in a different fashion. Likewise, the particular configuration of the cam ring 3 may vary depending on the particular key cylinder used for the narrow stile lock. That is, a different slotted arrangement than that depicted in FIG. 1 may be necessary to allow the clockwise and counterclockwise rotation of the cam ring around the key cylinder.

The inventive electronic lock can be used as a retrofit with an existing narrow stile lock or be manufactured as part of a new lock. In either case, the inventive electronic lock still permits lock operation independent of the cam ring so that exit from and entry into a particular area can be achieved independently of the electronic lock of the invention.

Although a pin solenoid is depicted as a preferred drive for the invention, any electrically actuated driver capable of imparting a longitudinal movement to the slide actuator plate so as to rotate the cam ring can be utilized as part of the invention.

Although a motion translation mechanism is illustrated to operate the door from the inside, any known type of manual device can be utilized to operate the narrow stile door latch from the inside of a particular area. Although the motion translation mechanism typically use a push paddle or push bar, any other type device may be utilized in combination with the invention.

As such, an invention has been disclosed in terms of preferred embodiments thereof which fulfill each and every one of the objects of the present invention as set forth hereinabove and provides a new and improved electronic lock.

Of course, various changes, modifications and alterations from the teachings of the present invention may be contemplated by those skilled in the art without departing from the intended spirit and scope thereof. Accordingly, it is intended that the present invention only be limited by the terms of the appended claims.

We claim:

1. An electronic lock comprising:

a) an electronically actuated driver;

b) an actuating hollow cylinder, the hollow cylinder having an inner wall concentric with the axis of the hollow cylinder sized to receive a key cylinder of a stile door lock, said actuating hollow cylinder having at least one protrusion sized to engage a portion of a latch assembly of said stile door lock, c) a coupling assembly configured to convert longitudinal movement of said electronically actuated driver to rotational movement of said actuating hollow cylinder, said rotational movement causing said at least one protrusion to engage said portion of said latch assembly to retract a latch of said latch assembly.

2. The electronic lock of claim 1 wherein said electrically actuated driver is a pin solenoid.

3. The electronic lock of claim 1 wherein said actuating hollow cylinder has a second protrusion thereon and said coupling assembly includes a plate configured to engage said second protrusion and be longitudinally driven by said electrically actuated driver, longitudinal movement of said plate causing said rotational movement of said actuating hollow cylinder.

4. The electronic lock of claim 3 wherein said plate is slidably mounted to said narrow stile door lock.

5. The electronic lock of claim 4 wherein at least one fastener is used to mount said plate to said narrow stile door lock, said plate having a slot opening therein to receive said fastener and permit said longitudinal movement.

6. The electronic lock of claim 3 wherein a filler block is used to position said plate with respect to said narrow stile door lock.

7. The electronic lock of claim 1 comprising a stile door lock in combination with said electrically actuated driver, said actuating hollow cylinder and said coupling assembly.

8. The electronic lock of claim 7 wherein said electrically actuated driver is a pin solenoid.

9. The electronic lock of claim 7 wherein said actuating hollow cylinder has a second protrusion thereon and said coupling assembly includes a plate configured to engage said second protrusion and be longitudinally driven by said electronically actuated driver, longitudinal movement of said plate causing said rotational movement of said actuating hollow cylinder.

10. The electronic lock of claim 9 wherein said plate is slidably mounted to said narrow stile door lock.

11. The electronic lock of claim 10 wherein at least one fastener is used to mount said plate to said narrow stile door lock, said plate having a slot opening therein to receive said fastener and permit said longitudinal movement.

12. The electronic lock of claim 7 wherein a filler block is used to position said plate with respect to said narrow stile door lock.

13. The electronic lock of claim 1 wherein the actuating hollow cylinder is configured to permit operation of said key cylinder by a key or retraction of said latch by an exit only dead latch assembly.

14. The electronic lock of claim 1, further comprising a motion translation mechanism mounted to the stile door lock to allow for egress from an area secured by said electronic lock, motion imparted to the motion translation mechanism retracting said latch for said egress, said motion translation mechanism operating independently of said hollow cylinder.

* * * * *